US009580998B2

(12) United States Patent
Foundas et al.

(10) Patent No.: US 9,580,998 B2
(45) Date of Patent: Feb. 28, 2017

(54) RECOVERY OR STORAGE PROCESS

(75) Inventors: Emmanuel Foundas, Harkaway (AU); Rodney Michael Bresnehan, Ashgove (AU)

(73) Assignee: CFT Technologies (HK) Limited, Sheung Wan (HK)

( * ) Notice: Subject to any disclaimer, the term of this patent is extended or adjusted under 35 U.S.C. 154(b) by 1447 days.

(21) Appl. No.: 13/147,758

(22) PCT Filed: Feb. 5, 2010

(86) PCT No.: PCT/AU2010/000118

§ 371 (c)(1),
(2), (4) Date: Nov. 1, 2011

(87) PCT Pub. No.: WO2010/088733

PCT Pub. Date: Aug. 12, 2010

(65) Prior Publication Data

US 2012/0037372 A1 Feb. 16, 2012

(30) Foreign Application Priority Data

Feb. 5, 2009 (AU) ..... 2009900440

(51) Int. Cl.
*E21B 43/00* (2006.01)
*E21B 43/30* (2006.01)
*E21B 41/00* (2006.01)

(52) U.S. Cl.
CPC ..... *E21B 43/006* (2013.01); *E21B 41/0057* (2013.01); *E21B 43/305* (2013.01)

(58) Field of Classification Search
CPC ..... E21B 43/30; E21B 43/305; E21B 43/006
See application file for complete search history.

(56) References Cited

U.S. PATENT DOCUMENTS 3,934,649 A 1/1976 Pasini, III et al.
4,519,463 A 5/1985 Schuh
(Continued)

FOREIGN PATENT DOCUMENTS

SU 1650908 A 5/1991
WO WO 02/42603 A1 5/2002

*Primary Examiner* — Elizabeth Gitlin
(74) *Attorney, Agent, or Firm* — Gable Gotwals

(57) ABSTRACT

A method for recovering gases and/or liquids stored within one or more gas and/or liquid reservoirs comprising locating the upper consolidated boundary of the one or more gas and/or liquid reservoirs; drilling an access well which extends downwardly to at least adjacent the upper consolidated boundary of the one or more gas and/or liquid reservoirs; drilling a section of the access well extending along or adjacent at least a portion of the upper consolidated boundary of the one or more gas and/or liquid reservoirs; creating permeability pathways into the one or more gas and/or liquid reservoirs to enable the release of gas and/or liquid from the one or more gas and/or liquid reservoirs into the access well; and recovering the released gas and/or liquid through the access well. The method is also used for storage or sequestering of gases and/or liquids into one or more gas and/or liquid reservoirs wherein permeability pathways are created to inject the gases and/or liquids into the reservoirs from the access well.

15 Claims, 1 Drawing Sheet

(56) References Cited

U.S. PATENT DOCUMENTS

| | | | | | |
|---|---|---|---|---|---|
| 4,978,172 | A * | 12/1990 | Schwoebel | E21F 7/00 166/369 |
| 5,133,410 | A | 7/1992 | Gadelle et al. | |
| 5,211,230 | A | 5/1993 | Ostapovich et al. | |
| 5,547,023 | A * | 8/1996 | McDaniel et al. | 166/280.1 |
| 7,513,304 | B2 * | 4/2009 | Stayton | 166/245 |
| 7,819,187 | B2 * | 10/2010 | Graham et al. | 166/245 |
| 2005/0087340 | A1 * | 4/2005 | Zupanick et al. | 166/245 |
| 2005/0121193 | A1 | 6/2005 | Buchanan et al. | |
| 2006/0131024 | A1 * | 6/2006 | Zupanick | 166/313 |
| 2008/0066903 | A1 * | 3/2008 | Zupanick | 166/245 |

* cited by examiner

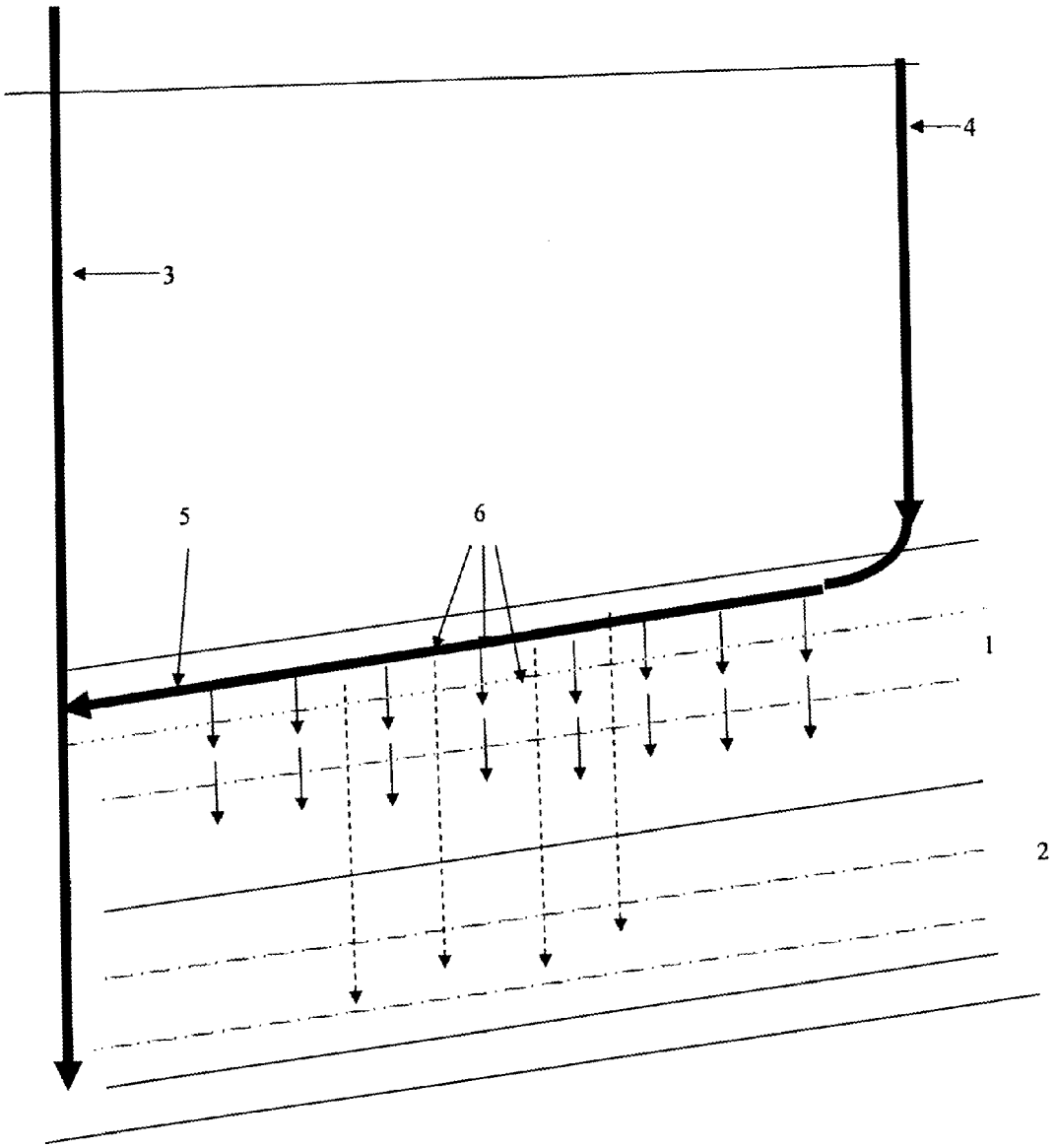
4
3
5
6
1
2

RECOVERY OR STORAGE PROCESS

CROSS-REFERENCE TO RELATED APPLICATIONS

This application is the United States National Phase of PCT Patent Application No. AU2010/000118 filed on 5 Feb. 2010, which claims priority to Australian Patent Application No. 2009 900440 filed 5 Feb. 2009, both of which are incorporated herein by reference.

FIELD OF THE INVENTION

The invention relates to a process for recovering gases and/or liquids adsorbed or otherwise trapped in rock or alternatively sequestering or storage of gases and/or liquids in rock. In particular, the process is adapted to be applicable to (but not limited to) the recovery of gases and/or liquids stored within one or more gas and/or liquid reservoirs. However, the process is usable to inject gases or liquids using the same configuration.

BACKGROUND OF THE INVENTION

In this specification, where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

Whilst the following discussion relates to coalbed methane, a person skilled in the art will understand that the invention is not limited to coalbed methane and can be used in the recovery or injection of other gases and/or liquids, including other hydrocarbons such as oil in shale and unconventional hydrocarbon resources.

Coalbed methane (CBM) (also known as coalbed gas, coal mine methane, and coal seam methane) is a form of natural gas extracted from coal beds. The term refers to methane adsorbed into the solid matrix of the coal. The presence of this gas is well known from its occurrence in underground coal mining, where it presents a serious safety risk due to its explosive nature. Coalbed methane is distinct from a typical sandstone or other conventional gas reservoir, as the methane is stored within the coal by a process called adsorption.

To extract the gas, a steel-encased hole is drilled into the coal seam (eg 100-1500 meters below ground). The hole exposes a face of the coal seam to lower pressure as opposed to the compressive pressure naturally applied to the rest of the seam which induces gas and water to escape from the coal seam. Additionally, water may be pumped from the coal seam which again induces the liberation of gas. The gas is collected and sent to a compressor station and, in turn, into natural gas pipelines.

Geologically, water typically permeates a coal seam and water pressure holds in place any CBM present. Producing CBM requires first removing the water to decrease the pressure on the coal matrix, allowing free gas to flow into the well bore. The 'produced water' is either reinjected into isolated formations in the reverse manner, released into streams, used for irrigation, or sent to evaporation ponds. The water typically contains dissolved solids such as sodium bicarbonate and chloride.

The methane desorption process follows a curve (of gas content vs. reservoir pressure) called a Langmuir isotherm. The isotherm can be analytically described by a maximum gas content (at infinite pressure), and the pressure at which half that gas exists within the coal. These parameters (called the Langmuir volume and Langmuir pressure, respectively) are properties of the coal, and vary widely. A coal in one state and a coal in another state may have radically different Langmuir parameters, despite otherwise similar coal properties.

As production occurs from a coal reservoir, the changes in pressure are believed to cause changes in the porosity and permeability of the coal. This is commonly known as matrix shrinkage/swelling. As the gas is desorbed, the pressure exerted by the gas inside the pores decreases, causing them to shrink in size and restricting further gas flow through the coal. As the pores shrink, the overall matrix shrinks as well, which may eventually increase the space the gas can travel through (the cleats), increasing gas flow.

The potential of a particular coalbed as a CBM source depends on the following criteria. Cleat density/intensity: cleats are joints confined within coal sheets. They provide permeability to the coal seam. A high cleat density is required for profitable exploitation of CBM. Also important is the maceral composition: maceral is a microscopic, homogeneous, petrographic entity of a corresponding sedimentary rock. A high vitrinite composition is ideal for CBM extraction, while inertinite hampers the same.

The rank of coal has also been linked to CBM content: a vitrinite reflectance of 0.8-1.5% has been found to imply higher productivity of the coalbed.

The gas composition must also be considered, because natural gas appliances are designed for gas with a heating value of about 1000 BTU (British thermal units) per cubic foot, or nearly pure methane. If the gas contains more than a few percent non-flammable gasses such as nitrogen or carbon dioxide, it will have to be blended with higher-BTU gas to achieve pipeline quality. If the methane composition of the coalbed gas is less than 92%, it may not be commercially marketable for gas sale, but at 50% or less may be used for power generation.

The current practice of drilling a bore into a coal seam to extract CBM raises a number of practical issues. One of the key problems is that the coal seam is often soft and collapses on itself making it difficult to bore. In fact, drilling operations are generally more difficult in coal per se, and in soft coal usually impossible to drill any distance as a result of jamming by such collapsing material.

There thus exists a need for an alternative method for recovering gas and/or liquids, such as CBM and other hydrocarbons, from gas and/or liquid reservoirs, especially soft geological materials such as coal, shale or sand.

SUMMARY OF THE INVENTION

According to a first embodiment of the invention, there is provided a method for recovering gases and/or liquids stored within one or more gas and/or liquid reservoirs comprising:

(a) locating the upper consolidated boundary of the one or more gas and/or liquid reservoirs;

(b) drilling an access well which extends downwardly to at least adjacent the upper consolidated boundary of the one or more gas and/or liquid reservoirs;

(c) drilling a section of the access well extending along or adjacent at least a portion of the consolidated upper boundary of the one or more gas and/or liquid reservoirs;

(d) creating permeability pathways from the one or more gas and/or liquid reservoirs to enable the release of gas and/or liquid from the one or more gas and/or liquid reservoirs into the access well; and (e) recovering the released gas and/or liquid through the access well.

In a preferred embodiment, a separate well is drilled to remove any water associated with the one or more gas and/or liquid reservoirs. The water well and removal process can be any such method known to a person skilled in the art.

A person skilled in the art will know that in many instances the access well and the section of the access well extending along or adjacent at least a portion of the consolidated upper boundary will typically be drilled as a single action. However, in other circumstances where there are gas and/or liquid reservoirs in different directions then the section of the access well extending along or adjacent at least a portion of the consolidated upper boundary may be drilled as a second step.

A person skilled in the art will know that the section of the access well extending along or adjacent at least a portion of the consolidated upper boundary will typically referred to as "horizontal" as it is non-vertical. A person skilled in the art will understand that in the context of the invention the term "horizontal" refers to any part of a well which is not vertical.

In a further preferred embodiment, the access well is lined or cased with an appropriate material such as steel or fibre glass.

A person skilled in the art will know that there are many ways to create the permeability pathways. For example, the permeability pathways may be created using perforating systems, jetting systems or sequential fracture stimulation systems. One example of a method to create permeability pathways is to use explosives as demonstrated by Halliburton's Cobra Frac service. Alternatively, the permeability pathways may be created using high pressure water jets.

The spacing of the permeability pathways will depend on the plans for the one or more gas and/or liquid reservoirs after the recovery of the gas and/or liquid. For example, if the one or more gas and/or liquid reservoirs is a coal seam, the coal may be mined once the methane is removed and therefore the permeability pathways may be spaced so that roof integrity of the seam is maintained to provide an access tunnel for the mining process.

The released gas and/or liquid is recovered using any standard recovery method known to a person skilled in the art.

A person skilled in the art will know that there are number of gases and/or liquids which may be sourced using the method according to the invention. Preferably, the gas and/or liquid is a hydrocarbon. More preferably, the hydrocarbon is methane or oil. For example, methane may be recovered from soft coal seams or low permeability sands or oil may be recovered from shale beds.

The advantage of the invention is achieved because the section of the access well extending along or adjacent at least a portion of the consolidated upper boundary does not enter the one or more gas and/or liquid reservoirs. This is in contrast to the prior art where the well is drilled into the one or more gas and/or liquid reservoirs.

According to a second embodiment of the invention, there is provided a method for recovering gases and/or liquids stored within one or more gas and/or liquid reservoirs comprising:

(a) locating the lower consolidated boundary of the one or more gas and/or liquid reservoirs;

(b) drilling an access well which extends downwardly to at least adjacent the lower consolidated boundary of the one or more gas and/or liquid reservoirs;

(c) drilling a section of the access well extending along or adjacent at least a portion of the consolidated lower boundary of the one or more gas and/or liquid reservoirs;

(d) creating permeability pathways from the one or more gas and/or liquid reservoirs to enable the release of gas and/or liquid from the one or more gas and/or liquid reservoirs into the access well; and (e) recovering the released gas and/or liquid through the access well.

A person skilled in the art will understand that this aspect of the invention allows for situations where the material above the gas and/or liquid reservoirs is not suitable for drilling and it is preferable to drill into the material which is below the gas and/or liquid reservoirs.

According to a third embodiment of the invention, there is provided a method for recovering gases and/or liquids stored within one or more gas and/or liquid reservoirs comprising:

(a) locating the upper and lower consolidated boundaries of the one or more gas and/or liquid reservoirs;

(b) drilling an access well which extends downwardly to at least adjacent the upper and lower consolidated boundaries of the one or more gas and/or liquid reservoirs;

(c) drilling a section of the access well extending along or adjacent at least a portion of the consolidated upper and lower boundaries of the one or more gas and/or liquid reservoirs;

(d) creating permeability pathways from the one or more gas and/or liquid reservoirs to enable the release of gas and/or liquid from the one or more gas and/or liquid reservoirs into the access well; and (e) recovering the released gas and/or liquid through the access well.

According to a fourth embodiment of the invention, there is provided a method for recovering methane stored within one or more coal seams comprising:

(a) locating the upper and/or lower consolidated boundary of the one or more coal seams;

(b) drilling an access well which extends downwardly to at least adjacent the upper and/or consolidated boundary of the one or more coal seams;

(c) drilling a section of the access well extending along or adjacent at least a portion of the consolidated upper and/or lower boundary of the one or more coal seams;

(d) creating permeability pathways from the one or more coal seams to enable the release of methane from the one or more coal seams into the access well; and (e) recovering the released methane through the access well.

Typically, the methane is trapped within the coal seam by water pressure. A person skilled in the art will understand that in such circumstances, the above method will further comprise drilling a water well and removing some water to release the methane from the coal seam.

There is also a desire to be able to store waste gases and/or liquids, such as carbon dioxide, to minimise their impact on the environment.

According to a fifth aspect of the invention, there is provided a method for sequestering or storage of gases and/or liquids into one or more gas and/or liquid reservoirs comprising:

(a) locating the upper and/or consolidated boundary of the one or more gas and/or liquid reservoirs;

(b) drilling an access well which extends downwardly to at least adjacent the upper and/or consolidated boundary of one or more gas and/or liquid reservoirs;

(c) drilling a section of the access well extending along or adjacent at least a portion of the consolidated upper and/or boundary of the one or more gas and/or liquid reservoirs;

(d) creating permeability pathways into the one or more gas and/or liquid reservoirs to enable the injection of gases and/or liquids into the one or more gas and/or liquid reservoirs from the access well; and (e) injecting gases and/or liquids into the one or more gas and/or liquid reservoirs.

A person skilled in the art will know what conditions will be applicable for the injection of a particular gas and/or liquid into a particular gas and/or liquid reservoir. For example, where carbon dioxide is being sequestered into a coal seam, the carbon dioxide will typically be injected under pressure into the coal seam.

DRAWINGS

Various embodiments/aspects of the invention will now be described with reference to the following drawing in which:

FIG. 1 is a drawing illustrating the method according to the invention.

DETAILED DESCRIPTION OF THE DRAWING

The gas and/or liquid reservoir consists of two coal seams (1, 2) with one (1) located above the other (2). The coal seams (1, 2) contain methane.

A vertical water well (3) is drilled to communicate with both coal seams (1, 2). At the top of the water well (3) is a water pumping installation (not shown).

An access well (4) is drilled into the drillable interbed extending downwardly to at least adjacent the upper and/or lower consolidated boundary of the upper coal seam (1) to within 1 meter of the upper coal seam (1). The access well (4) may be drilled using any steerable drilling system that can effectively measure the location of the drillbit accurately in conjunction with any suitable drilling mud system.

A section (5) is drilled extending along or adjacent at least a portion of the upper and/or lower consolidated boundary of the upper coal seam (1), wherein the section (5) also connects with the water well (3). The section (5) does not enter the coal seam (1). Preferably, the access well (4) and section (5) are within an appropriate distance of the upper coal seam (1) so that the system used to create the permeability pathways is effective and roof integrity is maintained where this is a requirement. For example, the access well (4) and section (5) may be within approximately 30 centimeters (1 foot) of the upper and/or lower boundary of upper coal seam (1).

A person skilled in the art will understand that a number of sections (5) may radiate out from a single access well (4) depending on the location of the coal seams. This would allow for a single methane recovery system to be used with respect to several coal seams. The design of the section (5) can be long or short radius depending on the physical attributes of the drillable interbed and the depth of the coal seam. One important consideration is the Measurement While Drilling (MWD) capability which enables the drill bit to remain within 1 meter over the entire length of the section (5) (eg 1 km) without entering the coal seam (1).

A steel or fibre glass lining (not shown) is inserted into the section (5).

Permeability pathways (6) are created in the coal seams (1, 2). A jetting system may be preferable to form the permeability pathways where there is more than one coal seam and the depth of penetration required is greater than the capability of a perforating gun.

Water is then removed via the water well (3) and once the water pressure is decreased, the methane will travel through the permeability pathways (6) into the section (5) and then the access well (4) and be recovered at the top of the access well (4) in a methane recovery system (not shown). The flow from the access well (4) should be closely controlled to prevent any high drawdown in the permeability pathways and thus prevent any unconsolidated coal movement towards the permeability pathways.

The word 'comprising' and forms of the word 'comprising' as used in this description and in the claims does not limit the invention claimed to exclude any variants or additions.

Modifications and improvements to the invention will be readily apparent to those skilled in the art. Such modifications and improvements are intended to be within the scope of this invention.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is limited only by the scope of the attached claims, including the full range of equivalency to which each element thereof is entitled.

The invention claimed is:

1. A method for recovering gases and/or liquids stored within one or more gas and/or liquid reservoirs, said method comprising the following steps:

(a) locating an upper consolidated boundary of the one or more gas and/or liquid reservoirs;

(b) drilling an access well which extends downwardly to at least adjacent the upper consolidated boundary of the one or more gas and/or liquid reservoirs;

(c) drilling a section of the access well extending along or adjacent at least a portion of the consolidated upper boundary of the one or more gas and/or liquid reservoirs, wherein the section of the access well does not enter the one or more gas and/or liquid reservoirs;

(d) creating permeability pathways from the section of the access well into the one or more gas and/or liquid reservoirs to enable the passive release of gas and/or liquid from the one or more gas and/or liquid reservoirs into the access well, the permeability pathways being created without drilling into the one or more gas and/or liquid reservoirs and using at least one of:

(i) a perforating system;

(ii) a jetting system;

(iii) a sequential fracture stimulation system;

(iv) explosives; and (v) high pressure water jets; and (e) recovering the released gas and/or liquid through the access well.

2. A method for recovering gases and/or liquids stored within one or more gas and/or liquid reservoirs, said method comprising the following steps:

(a) locating a lower consolidated boundary of the one or more gas and/or liquid reservoirs;

(b) drilling an access well which extends downwardly to at least adjacent the lower consolidated boundary of the one or more gas and/or liquid reservoirs;

(c) drilling a section of the access well extending along or adjacent at least a portion of the consolidated lower boundary of the one or more gas and/or liquid reservoirs, wherein the section of the access well does not enter the one or more gas and/or liquid reservoirs;

(d) creating permeability pathways from the section of the access well into the one or more gas and/or liquid reservoirs to enable the passive release of gas and/or liquid from the one or more gas and/or liquid reservoirs into the access well, the permeability pathways being created without drilling into the one or more gas and/or liquid reservoirs and using at least one of:
(i) a perforating system;
(ii) a jetting system;
(iii) a sequential fracture stimulation system;
(iv) explosives; and
(v) high pressure water jets; and (e) recovering the released gas and/or liquid through the access well.

3. A method for recovering gases and/or liquids stored within one or more gas and/or liquid reservoirs, said method comprising the following steps:

(a) locating upper and lower consolidated boundaries of the one or more gas and/or liquid reservoirs;

(b) drilling an access well which extends downwardly to at least adjacent the upper and lower consolidated boundaries of the one or more gas and/or liquid reservoirs;

(c) drilling a section of the access well extending along or adjacent at least a portion of the upper and lower consolidated boundaries of the one or more gas and/or liquid reservoirs, wherein the section of the access well does not enter the one or more gas and/or liquid reservoirs;

(d) creating permeability pathways from the section of the access well into the one or more gas and/or liquid reservoirs to enable the passive release of gas and/or liquid from the one or more gas and/or liquid reservoirs into the access well, the permeability pathways being created without drilling into the one or more gas and/or liquid reservoirs and using at least one of:
(i) a perforating system;
(ii) a jetting system;
(iii) a sequential fracture stimulation system;
(iv) explosives; and
(v) high pressure water jets; and (e) recovering the released gas and/or liquid through the access well.

4. A method for recovering methane stored within one or more coal seams, said method comprising the following steps:

(a) locating an upper and/or lower consolidated boundary of the one or more coal seams;

(b) drilling an access well which extends downwardly to at least adjacent the upper and/or lower consolidated boundary of the one or more coal seams;

(c) drilling a section of the access well extending along or adjacent at least a portion of the upper and/or lower consolidated boundary of the one or more coal seams, wherein the section of the access well does not enter the one or more coal seams;

(d) creating permeability pathways from the section of the access well into the one or more coal seams to enable the passive release of methane from the one or more coal seams into the access well, the permeability pathways being created without drilling into the one or more coal seams and using at least one of:
(i) a perforating system;
(ii) a jetting system;
(iii) a sequential fracture stimulation system;
(iv) explosives; and
(v) high pressure water jets; and (e) recovering the released methane through the access well.

5. The method according to claim 4 wherein drilling the access well extends to within 1 meter of the boundary of the one or more coal seams.

6. The method according to claim 4 wherein the access well and the section are within about 30 centimeters of the boundary of the one or more coal seams.

7. The method according to claim 4 wherein the permeability pathways are created using a jetting system.

8. The method according to claim 4 further comprising the step of drilling a water well.

9. The method according to claim 8 wherein the section also connects with the water well.

10. A method for sequestering or storage of gases and/or liquids into one or more gas and/or liquid reservoirs, said method comprising the following steps:

(a) locating an upper and/or lower consolidated boundary of the one or more gas and/or liquid reservoirs;

(b) drilling an access well which extends downwardly to at least adjacent the upper and/or lower consolidated boundary of one or more gas and/or liquid reservoirs;

(c) drilling a section of the access well extending along or adjacent at least a portion of the upper and/or lower consolidated boundary of the one or more gas and/or liquid reservoirs, wherein the section of the access well does not enter the one or more gas and/or liquid reservoirs;

(d) creating permeability pathways from the section of the access well into the one or more gas and/or liquid reservoirs to enable the injection of gases and/or liquids into the one or more gas and/or liquid reservoirs from the access well, the permeability pathways being created without drilling into the one or more gas and/or liquid reservoirs and using at least one of:
(i) a perforating system;
(ii) a jetting system;
(iii) a sequential fracture stimulation system;
(iv) explosives; and
(v) high pressure water jets; and (e) injecting gases and/or liquids into the one or more gas and/or liquid reservoirs.

11. The method according to claim 10 wherein drilling the access well extends to within 1 meter of the boundary of the one or more gas and/or liquid reservoirs.

12. The method according to claim 10 wherein the access well and the section are within about 30 centimeters of the boundary of the one or more gas and/or liquid reservoirs.

13. The method according to claim 10 wherein the permeability pathways are created using a jetting system.

14. The method according to claim 10 further comprising the step of drilling a water well.

15. The method according to claim 14 wherein the section also connects with the water well.

* * * * *